US010569994B2

(12) United States Patent
Kulak et al.

(10) Patent No.: US 10,569,994 B2
(45) Date of Patent: Feb. 25, 2020

(54) MONITORING SYSTEM, ELEVATOR DOOR SYSTEM HAVING MONITORING SYSTEM, AND METHOD

(71) Applicant: Otis Elevator Company, Farmington, CT (US)

(72) Inventors: Richard E. Kulak, Bristol, CT (US); Michael J. Tracey, Cromwell, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 632 days.

(21) Appl. No.: 15/220,496

(22) Filed: Jul. 27, 2016

(65) Prior Publication Data

US 2017/0029246 A1 Feb. 2, 2017

Related U.S. Application Data

(60) Provisional application No. 62/197,280, filed on Jul. 27, 2015.

(51) Int. Cl.
*B66B 13/30* (2006.01)
*B66B 13/24* (2006.01)

(52) U.S. Cl.
CPC ..... *B66B 13/24* (2013.01)

(58) Field of Classification Search
USPC ..... 187/393
See application file for complete search history.

(56) References Cited

U.S. PATENT DOCUMENTS 4,245,721 A 1/1981 Marvin
5,476,157 A * 12/1995 Todaro ..... B66B 13/24 187/280
5,659,159 A 8/1997 Koopman
6,206,143 B1 * 3/2001 Kammura ..... B66B 1/50 187/291
6,701,277 B2 3/2004 Coste et al.
6,857,507 B2 2/2005 Gallati et al.
7,252,180 B2 * 8/2007 Deplazes ..... B66B 5/02 187/314
7,637,355 B2 * 12/2009 Tyni ..... B66B 13/143 187/315
7,677,364 B2 * 3/2010 Begle ..... B66B 13/301 187/325
8,272,481 B2 * 9/2012 Tracey ..... B66B 13/301 187/333
8,584,809 B2 * 11/2013 Sun ..... B66B 13/26 187/316

(Continued)

FOREIGN PATENT DOCUMENTS

CN 1697775 A 11/2005
CN 1953928 A 4/2007

(Continued)

OTHER PUBLICATIONS

European Search Report for application EP 16181554.3, dated Jan. 9, 2017, 6 pages.

*Primary Examiner* — Christopher Uhlir
(74) *Attorney, Agent, or Firm* — Cantor Colburn LLP

(57) ABSTRACT

A sill gap monitoring system includes a sensor assembly configured to sense a sill gap between an elevator sill and at least one of a bottom surface of an elevator door and a bottom surface of a gib. The sill gap monitoring system generates an alert when the sill gap is greater than a sill gap limit.

4 Claims, 7 Drawing Sheets

(56) References Cited

U.S. PATENT DOCUMENTS

| | | | | |
|---|---|---|---|---|
| 10,101,142 | B2 * | 10/2018 | Bjorni | B66B 19/00 |
| 10,196,236 | B2 * | 2/2019 | Sonnenmoser | B66B 5/0018 |
| 2012/0198659 | A1 | 8/2012 | Giorgioni | |

FOREIGN PATENT DOCUMENTS

| | | | |
|---|---|---|---|
| CN | 101152947 | A | 4/2008 |
| CN | 102007063 | A | 4/2011 |
| JP | H06211444 | A | 8/1994 |
| JP | 2004149273 | A | 5/2004 |
| JP | 2005104654 | A | 4/2005 |
| JP | 4869790 | B2 | 2/2012 |
| JP | 2012071971 | A | 4/2012 |
| JP | 5068486 | B2 | 11/2012 |
| JP | 2013082542 | A | 5/2013 |
| JP | 2015101464 | A | 6/2015 |
| KR | 101324093 | A | 12/2012 |
| WO | 2011111096 | A1 | 9/2011 |

* cited by examiner

MONITORING SYSTEM, ELEVATOR DOOR SYSTEM HAVING MONITORING SYSTEM, AND METHOD

CROSS-REFERENCE TO RELATED APPLICATIONS

This application claims the benefit of U.S. provisional patent application Ser. No. 62/197,280, filed Jul. 27, 2015, the entire contents of which are incorporated herein by reference.

BACKGROUND

Embodiments of this disclosure pertain to an elevator door, and more particularly to a monitoring assembly for use with an elevator door.

Elevator systems are widely known and used. A typical elevator system includes an elevator cab that moves within a hoistway between landings in a building, for example, to transport passengers, cargo or both between building levels. Typically, a hoistway entrance includes at least one landing door that hangs from a set of rollers that roll along a track near the top of the hoistway entrance. The cab also has at least one door. An actuator supported on the cab moves the cab and landing doors between open and closed positions when the cab is at a landing. The bottom of each elevator door includes a gib that is received into a guide groove within a door sill near the bottom of the door. The gib follows the guide groove as the elevator door moves. The gib and guide groove also cooperate to keep the door plumb.

When the landing doors of a particular landing are closed, the hoistway is inaccessible to passengers and cargo, thus blocking the passengers and cargo, as well as other passerbys, from access to the hoistway when the cab is not at that particular landing. In this closed position, the gib must remain in the guide groove so that the landing door does not swing into the hoistway if it is bumped by the cargo, passengers, or passerbys. If the gib is not properly seated in the guide groove and the landing door is accidentally bumped, the landing door is at risk of swinging into the hoistway. Field adjustment of the landing doors is required to achieve prober gib engagement with the sill, and routine maintenance to ensure the gib is properly seated in the guide groove should be conducted.

BRIEF DESCRIPTION

A sill gap monitoring system includes a sensor assembly configured to sense a sill gap between an elevator sill and at least one of a bottom surface of an elevator door and a bottom surface of a gib. The sill gap monitoring system generates an alert when the sill gap is greater than a sill gap limit.

The sill gap monitoring system may be operatively attached adjacent to a bottom surface of the elevator door.

The sensor assembly may be operatively attached to the sill or operatively attached to a bottom surface of the gib.

The sensor assembly may include a non-contact sensor including one of sound, light, and magnetic detection to sense the sill gap.

The sensor assembly may include a sensor configured to make physical contact between the sill and at least one of the door and the gib.

The sensor may be a microswitch having a roller operatively engaged with the sill during movement of the door from an open position to a closed position.

The sensor assembly may include a plunger movable within a plunger housing towards the sill. The plunger may be connected to an actuator, the actuator moving in a first direction to move the plunger towards the sill when the door is in a closed position and moving in a second direction opposite the first direction to move the plunger away from the sill when the door is in an open position.

When the sill gap limit is exceeded, a plunger head of the plunger may contact the plunger housing and a circuit within the sensor assembly may be closed and send a signal to generate the alert. When the sill gap limit is not exceeded, the plunger head may not contact the plunger housing and the circuit may be open.

An elevator door system may include an elevator door movable from an open position to a closed position, the elevator door having a bottom surface, a gib secured to the elevator door adjacent the bottom surface, a sill having a guide groove and a face, the gib slidable within the guide groove, the face facing the bottom surface of the elevator door in the closed position, and a sill gap monitoring system including a sensor assembly configured to sense a sill gap between the sill and at least one of the bottom surface of the elevator door and the gib. An alert is generated by the sill gap monitoring system when the sill gap is greater than a sill gap limit.

The elevator door may be a landing door at a hoistway entrance.

At least a portion of the sensor assembly may be operatively attached to the sill. Alternatively, at least a portion of the sensor assembly may be attached to and movable with the elevator door.

The sensor assembly may sense the sill gap continuously along a length of the sill during movement of the door between the open and closed positions.

The sensor assembly may include a microswitch having a roller operatively engaged with the sill during movement of the door from an open to a closed position.

The sensor assembly may be activated to sense the sill gap when the door is in the closed position and deactivated when the door is in the open position.

The sensor assembly may include a non-contact sensor including one of sound, light, and magnetic detection to sense the sill gap.

The sensor assembly may include a plunger movable within a plunger housing towards the sill, wherein, when the sill gap limit is exceeded, a plunger head of the plunger may contact the plunger housing and a circuit within the sensor assembly may be closed and send a signal to generate the alert. When the sill gap limit is not exceeded, the plunger head may not contact the plunger housing and the circuit is open.

A method of monitoring an elevator door sill gap includes selecting a sill gap limit between a sill and at least one of a gib and a bottom surface of an elevator door; configuring a sensor to monitor the sill gap; sending a signal from the sensor when the sill gap exceeds the sill gap limit; arranging a controller to receive the signal from the sensor; and, generating an alert when the sill gap limit has been exceeded.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
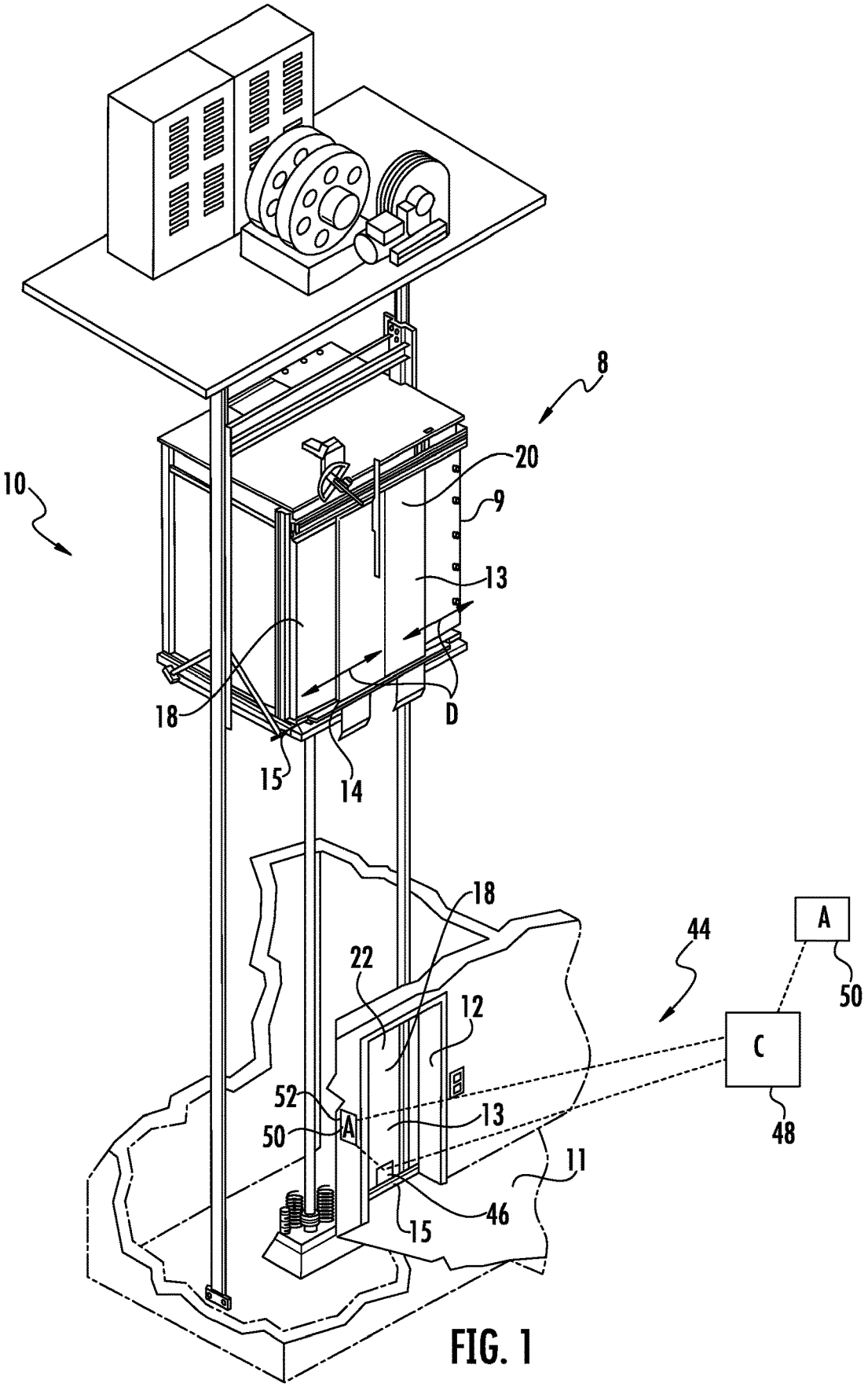
FIG. 1 shows a perspective view of an embodiment of an elevator system having a gap monitoring system.

FIG. 1 shows selected portions of an embodiment of an elevator assembly 8 including a cab 9 that moves within a hoistway 10 between building levels or landings 11 (one shown). The cab 9 and a hoistway entrance 12 each include an elevator door system 18 having elevator doors 13, more particularly cab doors 20 and landing doors 22, that move in a direction of elevator door movement D between open and closed positions. Although double doors 13 are illustrated on the cab 9, one or each of the cab 9 and the hoistway entrance 12 may include a single door 13. The elevator door assemblies 18 each include one or more retainers 14, hereinafter referred to as a "gib," which are fixedly coupled to each of the elevator doors 13. The gibs 14 are guided within a sill 15 on the cab 9 and at the hoistway entrance 12.

Figure 2:
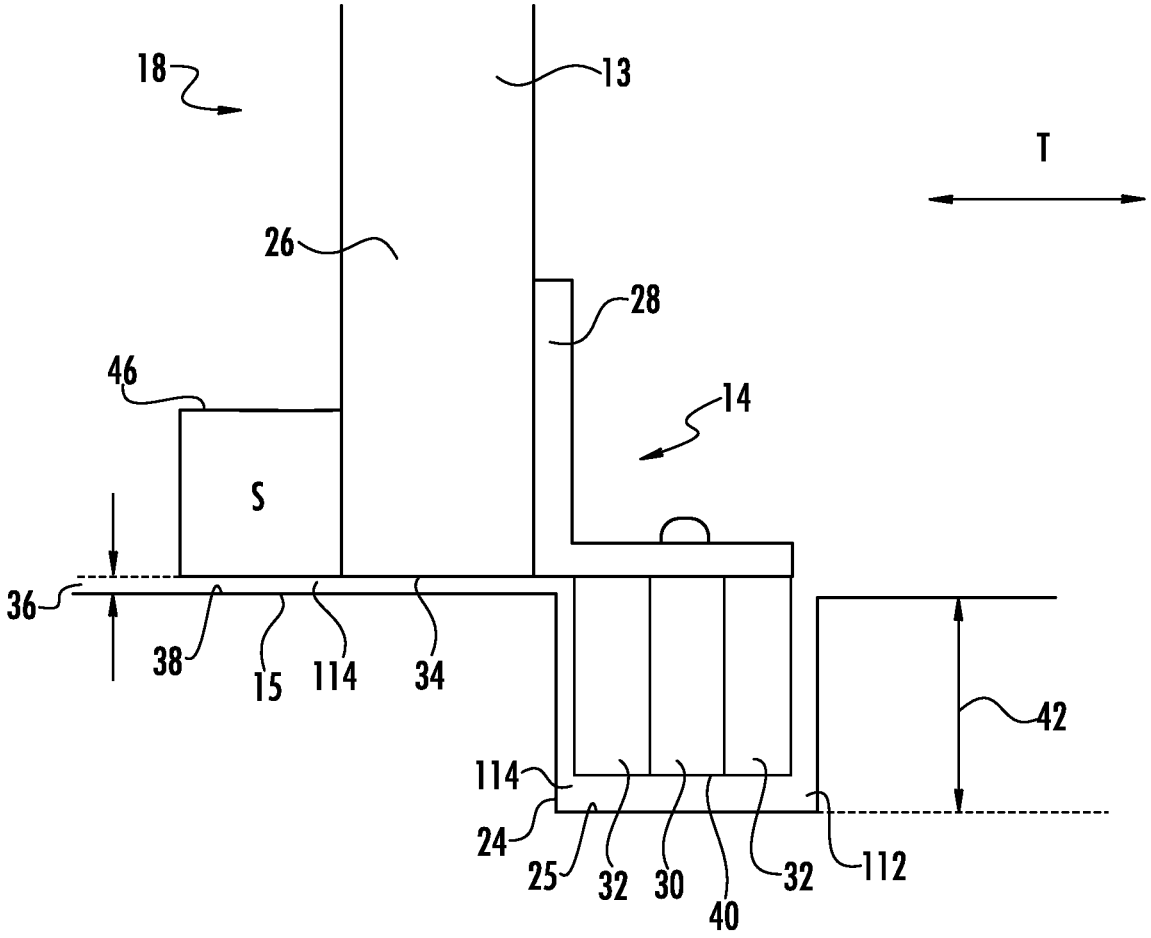
FIG. 2 shows a partial side cross-sectional view of an elevator door system.

As further shown in FIG. 2, the sills 15 include a slot or guide groove 24, having a depth 42, to slidably receive the gibs 14. With the gibs 14 in the guide groove 24 of the sills 15, the elevator doors 13 are guided in the direction of door movement D (FIG. 1) to control the motion of the elevator doors 13 and to maintain the elevator doors 13 plumb such that the lower portion 26 of each door 13 near the sill 15 does not move significantly in directions transverse to the direction of door movement D. As shown in FIG. 2, movement of the door in directions T is substantially restricted via receipt of the gib 14 in the guide groove 24. Field adjustment achieves proper engagement of the gibs 14 within the sills 15 and with respect to any relevant codes. While the gibs 14 are illustrated as having an L-shaped attachment portion 28, a reinforcement beam 30 (including, by example only, a metal) and glides 32 (including, by example only, a nylon) for reducing friction, the gibs 14 may be any shape and made of any materials or combination of materials suitable for attaching to the door 13 and include any portions for engaging with the guide groove 24 in the sill 15. Further, while the illustrated gib 14 may be installed to an exterior surface of the door 13, the gib 14 may be alternatively integrally positioned between exterior panels of the door 13.

The doors 13 are installed or adjusted so that the bottom surface 34 of the door 13 is within a certain distance 36 from the face 38 of the sill 15, so that the installer or maintenance staff will know that the gibs 14 are properly seated within the guide groove 24. The small gap between the bottom surface 34 of the door 13 and the face 38 of the sill 15 will hereinafter be referred to as a door gap 36. While the face 38 of the sill 15 is illustrated as substantially planar, it should be understood that the sill 15 may be grooved such as for traction purposes. It has been determined that, over time, the door gap 36 between the bottom surface 34 of the elevator door 13 and the face 38 of the sill 15 may change due to high sill loading (such as by repeatedly moving heavy items over the sill 15), door impacts, door adjustments or roller adjustments on the track at the top of the door 13, or an incorrect installation. If the door gap 36 becomes too great and exceeds a maximum allowable sill gap (a sill gap limit), then a distance 112 (gib gap 112) between a bottom surface 40 of the gib 14 and the bottom surface 25 of the guide groove 24 increases. Also, a distance between a bottom surface 40 of the gib 14 and the face 38 of the sill 15 correspondingly reduces, thus reducing the length of the gib 14 within the guide groove 24. The gib 14 in such a scenario may not fully or properly seat within the guide groove 24 in the sill 15, which may lead to a deleterious change in door panel impact resistance, particularly if the landing door 22 is impacted near the lower portion 26.

Thus, in accordance with embodiments of this disclosure, a gap monitoring system 44 (FIG. 1) is included in the elevator door system 18 for monitoring, sensing and/or measuring one or both of the door gap 36 and the gib gap 112. Because the guide groove 24 is within the sill 15, both the door gap 36 and the gib gap 112 are herein collectively referred to as sill gaps 114. It is further noted that the sill 15 may be one integral unit or may include separate portions for the guide groove 24 and the face 38, and therefore the sill refers to any portion below the respective door 13 and gib 14. The gap monitoring system 44 includes a sensor assembly 46 installed at one or all of the landing door 22, gib 14, and the sill 15 to detect if the door gap 36 and/or gib gap 112 exceeds a gap limit when the landing door 22 is in the closed position. The sensor assembly 46 may include a contact type or non-contact type of sensor for monitoring, sensing, measuring, and/or detecting at least one of the gap 36 and gap 112. For illustrative purposes only, the sensor assembly 46 in FIG. 2 is depicted as positioned to measure the door gap 36 and on an opposite side of the door 13 than the attachment portion 28 of the gib 14, however it should be understood that both the gib 14 and the sensor assembly 46 may be connected to a same side of the landing door 22, or within exterior panels of the landing door 22. Also, while the gap monitoring system 44 is described with respect to monitoring the gap 36 or gap 112 between the landing door 22/gib 14 and the sill 15 at the hoistway entrance 12, it may, if desired, be further incorporated to monitor a gap between the cab door 20 and/or gib 14 and the sill 15 of the cab 9. If there are two doors 13 at a particular landing 11 or cab 9, then a sensor assembly 46 may be attached to one or both doors 13 or to separate locations along the sill 15. Also, the gap monitoring system 44 may be retrofitted onto any existing elevator door 13 to monitor for a gap maintenance condition that needs to be addressed.

With reference again to FIG. 1, the gap monitoring system 44 may further include a controller 48 to receive a signal from the sensor assembly 46 indicating that the gap limit has been reached or exceeded. The controller 48 may process the signal and determine any next steps. Such next steps may include the generation and sending of a notification or alert. The alert, diagrammatically shown at 50, may be sent to onsite personnel (such as the onsite maintenance department) or offsite personnel (such as to a property manager or remote elevator monitoring company), for the coordination of a maintenance adjustment of the affected door 13, maintenance to the sill 15, maintenance to the gib 14, or maintenance to any portion of the elevator door system 18. Alternatively or additionally, the alert 50 may be localized, such as shown at area 52, and may take the form of a light, indicia on an electronic display, or sound-emitting device such as a buzzer. The localized alert 50 may be triggered as soon as the signal from the sensor assembly 46 senses a sill gap limit has been reached or exceeded, or may be triggered via the controller 48. The controller 48 may also store the signal in a memory for subsequent documentation and review of sill gap conditions for each landing door 22.

Figure 3:
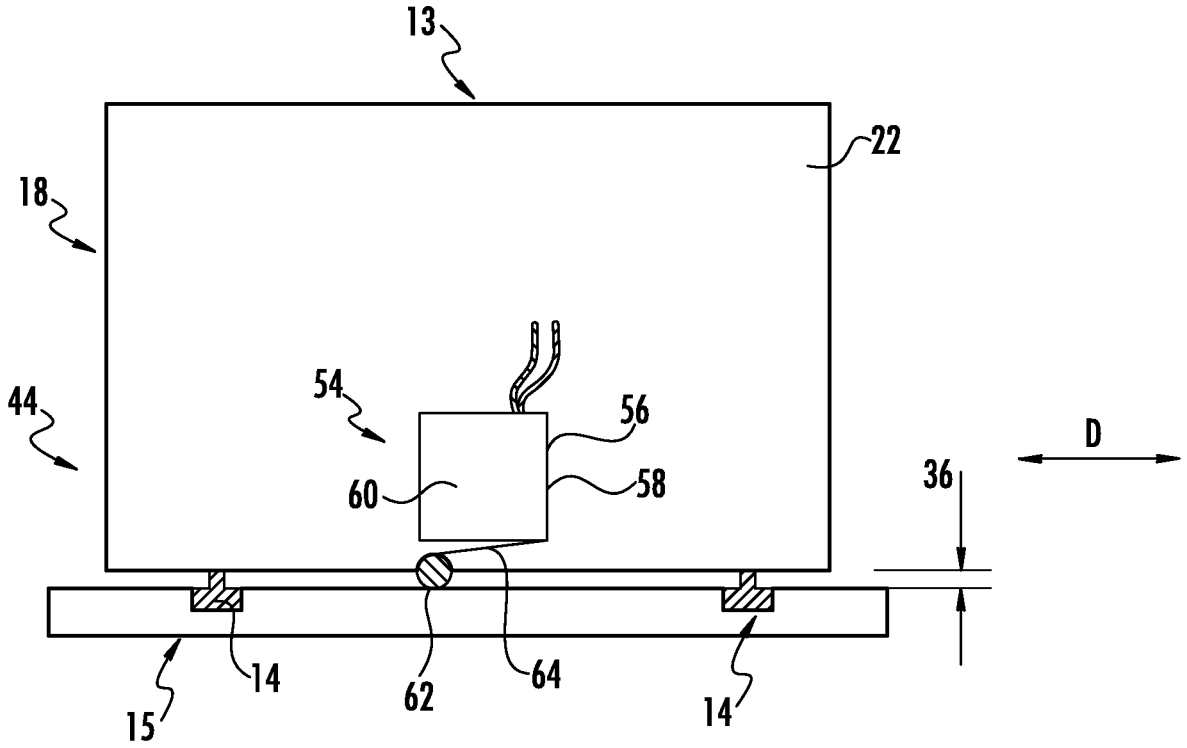
FIG. 3 shows a diagrammatic view of one embodiment of portions of a gap monitoring system for the elevator system of FIG. 1.
Figure 10:
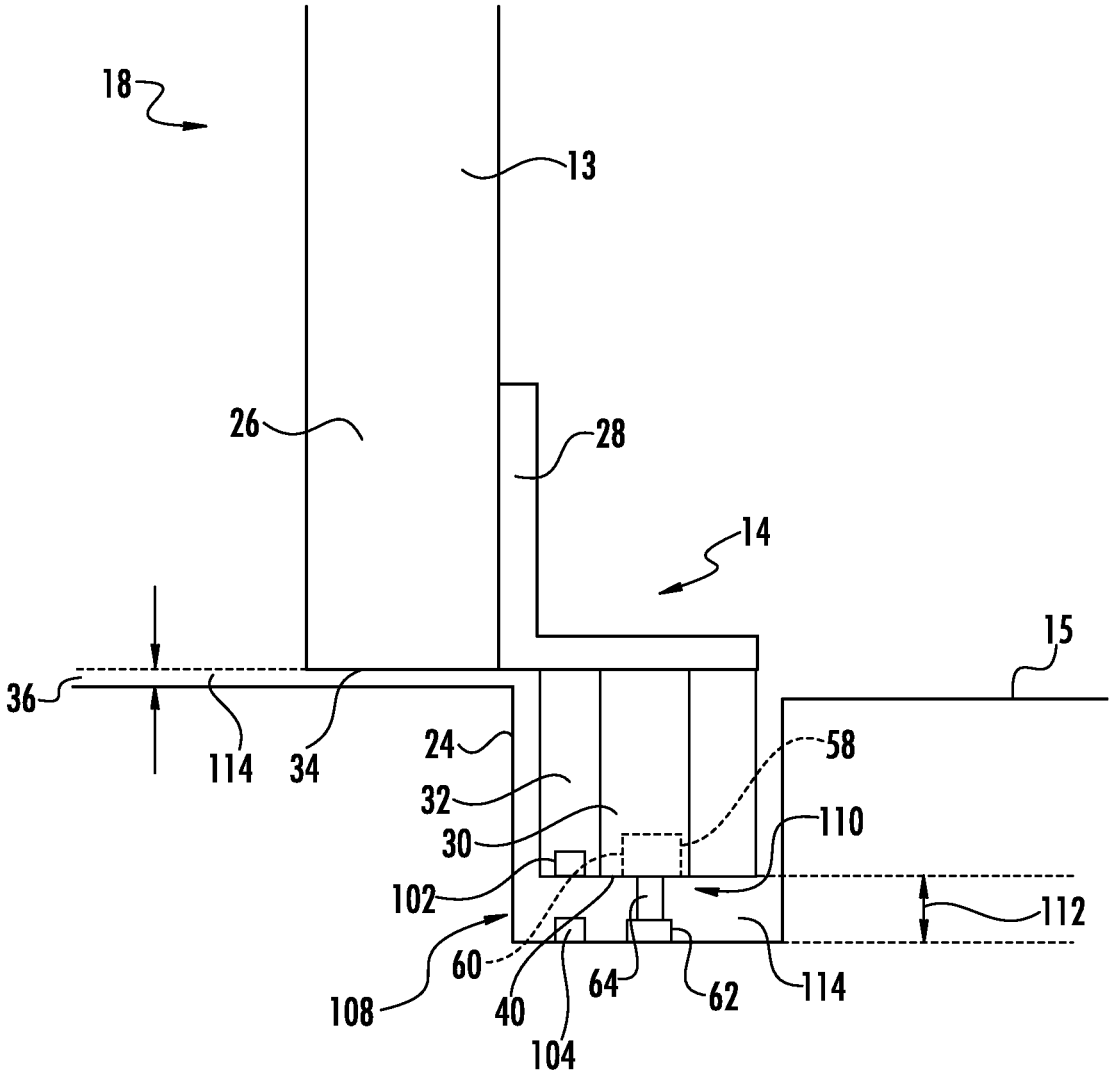

One embodiment of portions of the gap monitoring system 44 is shown in FIG. 3. The door 13, such as the landing door 22, includes at least one gib 14 (two depicted, for illustrative purposes) fixedly attached to the door 13 for sliding movement within the sill 15 in directions D during the opening and closing of the door 13. A sensor assembly 54 of the gap monitoring system 44 is also fixedly attached to the door 13, such that the sensor assembly 54 moves with the door 13 in directions D during the opening and closing of the door 13. The sensor assembly 54 may include a contact sensor 56 such as a microswitch 58 having a body 60 aligned with or adjacent to the bottom surface 34 of the door 13, a roller 62, and a switching arm 64 connecting the roller 62 to the body 60. The roller 62 contacts the sill 15 during opening and closing of the door 13 and therefore movement of the switching arm 64 to close or open the microswitch 58 is directly related to the distance (door gap 36) between the sill 15 and the bottom surface 34 of the door 13. The sensor assembly 54 could be designed to close (and thus send a signal) when the door gap 36 has met or exceeded the sill gap limit. For example, if the sill gap limit is 6 mm, then the sensor assembly 54 may electrically make and send a signal to the controller 48 when the door gap 36 exceeds 6 mm (or meets 6 mm) to alert that a maintenance condition exists. Alternatively, the sensor assembly 54 could be designed to close (and thus send a signal) when the door gap 36 is within an acceptable tolerance, such that the controller 48 would construe the loss of signal as an indication that the door gap 36 has exceeded the sill gap limit. In either case, the sensor assembly 54 is preset to an activation distance of the sill gap limit, where the sill gap limit is any distance selected by the operator/installer useful in determining a maintenance condition. This embodiment demonstrates a gap monitoring assembly 44 that monitors the door gap 36 along substantially an entire length of travel of the sensor assembly 54 with the door 13 and along a length of the sill 15. Alternatively, while the sensor assembly 54 is depicted as attached to the door 13, in another embodiment, the sensor assembly 54 may be attached to the sill 15 such that movement of the door 13 over the sensor assembly 54 will send a signal indicating if the door gap 36 between the door 13 and the sill 15 has exceeded the sill gap limit. In such an embodiment, the sensor assembly 54 may be installed adjacent to the location or locations of the gib 14 to alert when the door gap 36 adjacent the gib 14 has exceeded the sill gap limit. In yet another embodiment, as depicted in FIG. 10, a sensor assembly 110 may include the microswitch 58 as described with respect to FIG. 3, but may instead be installed on the gib 14 or the bottom surface 25 of the guide groove 24 and operatively arranged to send a signal indicating if the gib gap 112 has exceeded the sill gap limit. In any of the above-described embodiments, whether installed on the door 13, face 38 of sill 15, gib 14, or bottom surface 25 of guide groove 24, the signal from at least one of the sensor assembly 54 and 110 may be sent to the controller 48 as described with respect to FIG. 1 and/or to one or any of the alert locations 50.

Figure 4:
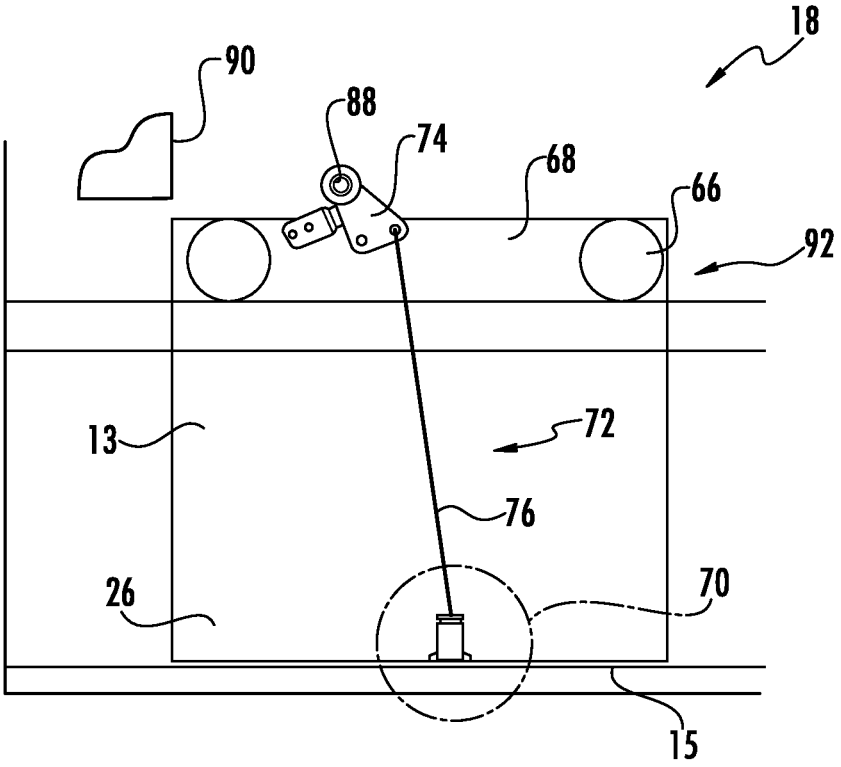
FIG. 4 shows a diagrammatic view of another embodiment of portions of a gap monitoring system when the elevator door is open or opening.
Figure 5:
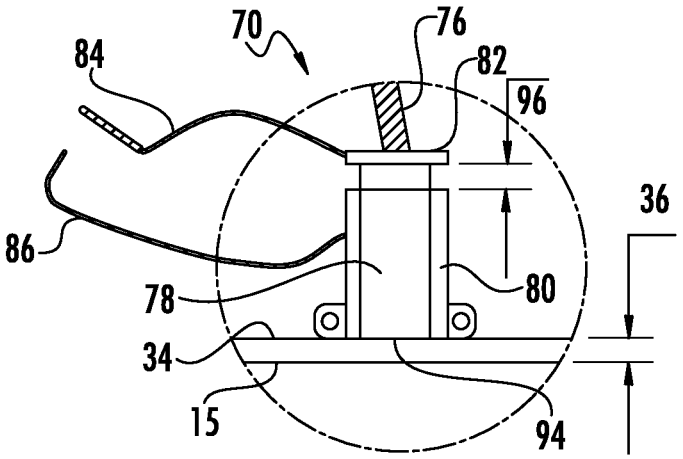
FIG. 5 shows an enlarged view of a sensor assembly for use in the gap monitoring system of FIG. 4.
Figure 6:
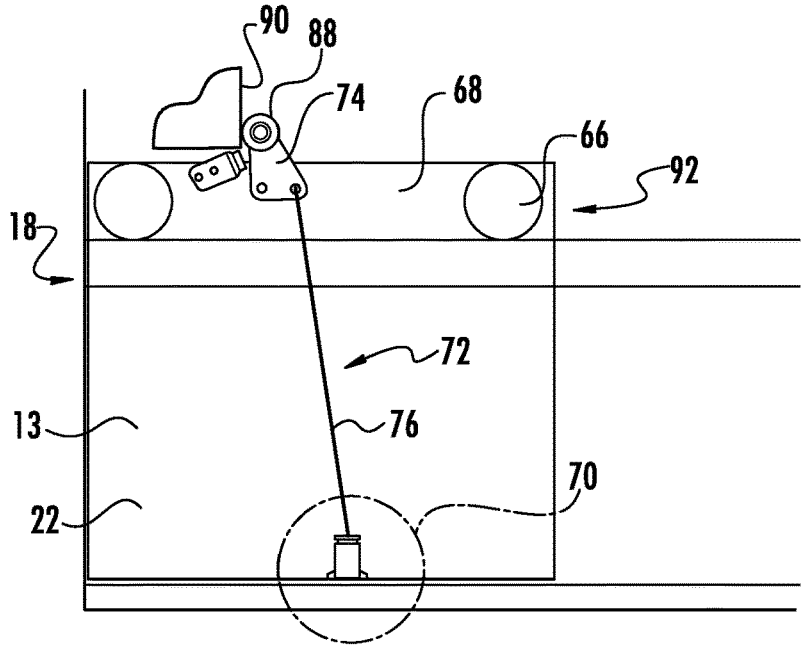
FIG. 6 shows a diagrammatic view of the embodiment of the gap monitoring system of FIG. 4 when the elevator door is closed.
Figure 7:
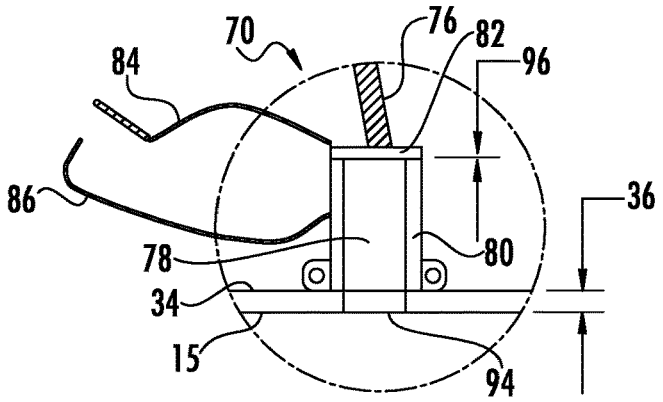
FIG. 7 shows an enlarged view of the sensor assembly of FIG. 5 when the gap is not exceeded.
Figure 8:
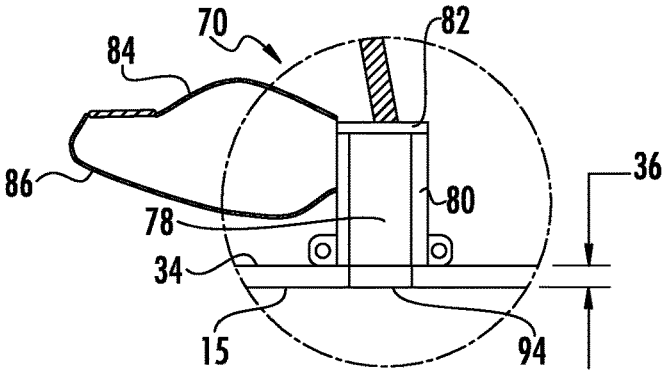
FIG. 8 shows an enlarged view of the sensor assembly of FIG. 5 when the gap is exceeded.

Another embodiment of portions of a sill gap monitoring system 44 is shown in FIGS. 4-8. Although not illustrated, one or more gibs 14 slide within a guide groove 24 in the sill 15, as in the previous embodiment. The roller assembly 66 for moving the door 13 in directions D parallel to the guide groove 24 is shown adjacent the upper portion 68 of the door 13. A sensor assembly 70 is attached to the lower portion 26 of the door 13 and only senses the sill gap 114 when the door 13 is closed (FIG. 6), since it is not necessary to know the door gap 36 when the door 13 is open (FIG. 4) since the door 13, in particular the landing door 22, is only open when the cab 9 is at the landing 11. While the sensor assembly 70 is illustrated and described with respect to sensing the door gap 36, it should be understood that the sensor assembly 70 may alternatively be incorporated within the gib 14 to sense the gib gap 112. FIG. 4 shows the open position of the door 13 where a sensor actuator 72 deactivates the sensor assembly 70. In one embodiment, the sensor actuator 72 includes a movable, such as pivotal, lever 74 in a first condition (which may be a spring biased position) that pulls a mechanical link 76 upwardly such that a sensor assembly plunger 78, within a plunger receiving housing 80 attached to the door 13 (or attached to gib 14), is in a first, upwardly pulled first position, as shown in FIG. 5. When the plunger 78 is moved to the first position, the plunger head 82 is separated from the housing 80 by a distance 96, and therefore the plunger head 82 does not make contact with the housing 80 and circuit wires 84, 86, connected respectively to the plunger head 82 and housing 80, are disconnected so that no signal is sent to the controller 48 and no alert 50 is made or sent. When the door 13 is closing and/or fully closed as shown in FIG. 6, the lever 74 rotates, such as in the clockwise direction as shown in FIG. 6, when a roller 88 attached to the lever 74 contacts a surface 90, which may include a stationary ramp, a portion of a coupler on the car 9, a landing door interlock, or other area of hoistway header 92. The link 76 attached to the lever 74 actuates the sensing function of the sensor assembly 70 by moving the plunger end 94 or the plunger 78 to the sill 15. As shown in FIG. 7, the wires 84, 86 are not connected and no signal is sent when the plunger head 82 does not contact the housing 80. Note that the distance 96 in FIG. 7 is smaller than the distance 96 in FIG. 5, however the lack of contact between the plunger head 82 and housing 80 still keeps the circuit between the wires 84, 86 open. Since the travel of the plunger 78 to the sill 15 cannot place the plunger head 82 into contact with the housing 80, the door gap 36 (or gib gap 112) is below the sill gap limit (for example, less than 6 mm, although the sill gap limit may be the same or different for the door gap 36 and the gib gap 112) and no signal is sent, and thus no alert 50 is provided. However, as shown in FIG. 8, if the travel of the plunger 78 is such that the plunger head 82 contacts the housing 80 (eliminating the distance 96 between the plunger head 82 and the housing 80), then the circuit wires 84, 86 are connected, a signal is sent, and an alert 50 is provided to indicate that the sill gap limit has been reached or exceeded. Even if the plunger end 94 cannot reach the sill 15, the plunger head 82 will still contact the housing 80 and the signal will be sent to indicate that the sill gap limit has been exceeded.

While the lever 74 shown in FIGS. 4 and 6 may be a separate element used in a retrofit sill gap monitoring system 44, alternatively the link 76 may be attached to an existing component of the elevator door assembly 18, such as, but not limited to a landing side interlock that couples the landing doors 22 to the cab doors 20 or another door mechanism. Also, while a mechanical actuation of the sensor assembly 70 has been described, the sensor assembly 70 may alternatively be electrically or magnetically actuated, such as, for example, initiating movement of the plunger 78 within the plunger housing 80 when the door 13 passes over a certain location along the sill 15, such as near the gibs 14. Furthermore, while one particular embodiment of the sensor actuator 72 may include the lever 74 and link 76 as shown, other sensor actuators, including either mechanical or electrical/magnetic actuators, configured to actuate a sensor assembly 70 may also be incorporated into at least one of the door 13, gib 14, and the sill 15.

Figure 9:
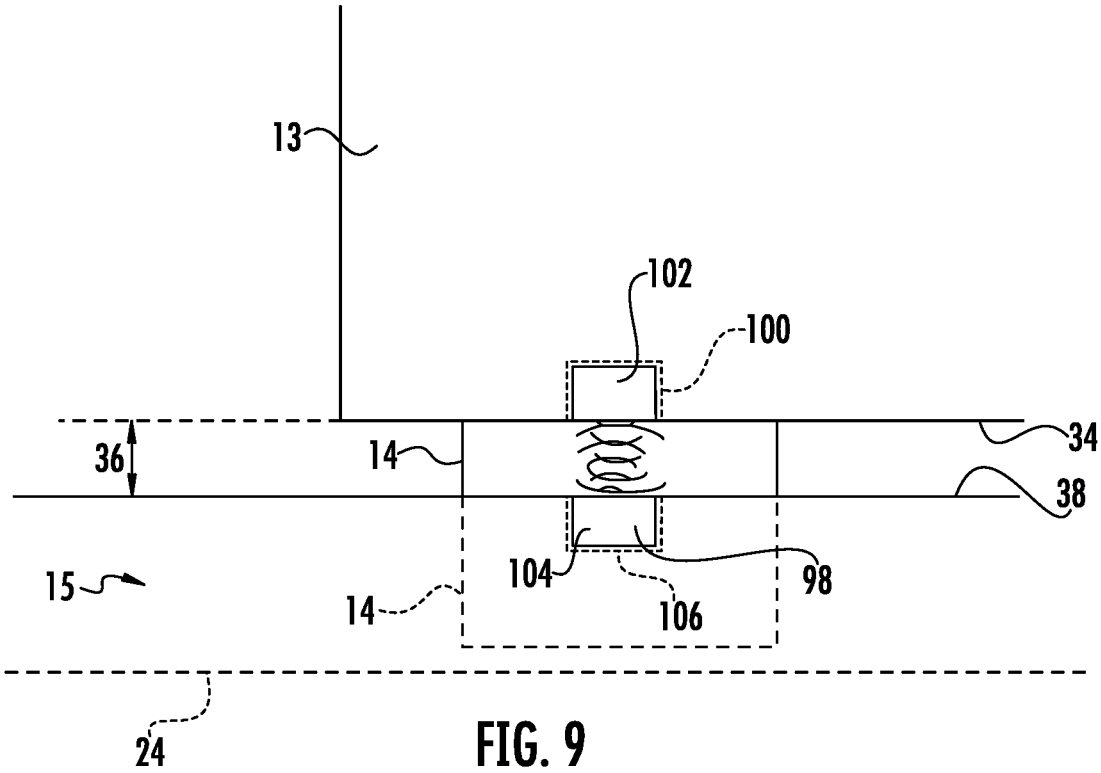
FIG. 9 shows a diagrammatic view of another embodiment of portions of a gap monitoring assembly for the elevator system of FIG. 1; and, FIG. 10 shows a diagrammatic view of another embodiment of portions of a gap monitoring assembly for the elevator system of FIG. 1.

Other embodiments of portions of a gap monitoring assembly 44 are demonstrated by FIG. 9. While the prior embodiments are based on contact type sensor assemblies 54, 70 to determine if the door gap 36 (or gib gap 112) has exceeded a sill gap limit, FIG. 9 demonstrates embodiments that rely on a non-contact type sensor assembly 98. The sensor assembly 98 may, for example, include a sensor 104, such as an ultrasonic sensor, at the sill 15 (or alternatively on the door 13), which propagates sound waves to a location 100 along the door 13 (or to a location 106 on the sill 15) when the door 13 is in the closed position. The location 100 (or location 106) may include a receiver 102, or alternatively the sensor 104 may include both the transducer and the receiver. With additional reference to FIG. 10, a sensor assembly 108 including the sensor 104 and receiver 102 may also be positioned on the gib 14 and guide groove 24. The length of time that the sound takes to reach the receiver (whether at the door location 100 or at the sill location 106) is proportional to the sill gap 114. Thus, information regarding the door gap 36 and/or gib gap 112 may be sent to the controller 48. The sensor 104 may be configured to periodically initiate the sensing function, or may be triggered to initiate the sensing function by a movement of the door 13. The sensor 104 may alternatively include a distance measuring photoelectric sensor positioned at either the sill 15 at location 106 or on the door 13 at location 100. Due to the small distances being measured in the door gap 36 and gib gap 112, the photoelectric sensor may utilize triangulation, which determines the distance of the target (the door 13, gib 14, or sill 15) based on the angle of the light reflected on the sensor receiver 102 from the target. The photoelectric sensor may utilize pulsed infrared, visible red, or laser light, or the sensor assembly 98 may alternatively include as sensors 104 an inductive distance sensor for metallic targets (where the sill 15 and/or the door 13 are made of metal), a magnetic sensor (where the absence of detection of a magnetic field due to an excessive door gap 36 may trigger an alert), or other distance measuring sensor 104. In any of the above-described embodiments, the sensor 104 may be positioned at the location 100 along the door 13 or gib 14 instead of at the sill 15. Also, the sensor 104 may be recessed from the face 38 of the sill 15, from the bottom 40 of gib 14, from the bottom surface 34 of the door 13, or from the bottom surface 25 of the guide groove 24.

FIG. 10 further illustrates an embodiment where a plurality of sensor assemblies, which may be the same type of sensor assembly or different types of sensor assembly, are utilized in the sill gap monitoring system 44. The use of two or more sensor assemblies provides redundancy and back-up in the event one sensor assembly becomes inoperative.

Using embodiments of the sill gap monitoring system 44 described herein, at least one sill gap 114, including at least one of the door gap 36 and gib gap 112, is routinely and automatically monitored and an alert 50 is sent when the sill gap limit is met or exceeded. The sill gap monitoring assembly 44 may automatically check the sill gap 114 on each door cycle eliminating the possibility of human oversight from a mechanic or inspector, and is capable of detecting any deviations in the sill gap 114 over time. The monitoring of the sill gap 114 can thus take place many times, including hundreds and even thousands of times, in between routine maintenance checks of the sill gap 114 by personnel. Electrical monitoring can be used for signaling a maintenance instruction which can, with proper follow-up maintenance attention, prevent the gib 14 from disengaging with the guide groove 24 in the sill 15. A method of monitoring the sill gap 114 using the sill gap monitoring system 44 may include setting the sill gap limit within the sensor assembly 46 or controller 48, sensing the sill gap 114, and generating the alert 50 when the sill gap limit is met or exceeded.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A sill gap monitoring system comprising:

a sensor assembly configured to sense a sill gap between an elevator sill and at least one of a bottom surface of an elevator door and a bottom surface of a gib;

wherein the sill gap monitoring system generates an alert when the sill gap is greater than a sill gap limit;

wherein the sensor assembly includes a plunger movable within a plunger housing towards the sill.

2. The sill gap monitoring system of claim 1, wherein the plunger is connected to an actuator, the actuator moving in a first direction to move the plunger towards the sill when the door is in a closed position and moving in a second direction opposite the first direction to move the plunger away from the sill when the door is in an open position.

3. The sill gap monitoring system of claim 1, wherein, when the sill gap limit is exceeded, a plunger head of the plunger contacts the plunger housing and a circuit within the sensor assembly is closed and sends a signal to generate the alert, and wherein, when the sill gap limit is not exceeded, the plunger head does not contact the plunger housing and the circuit is open.

4. An elevator door system comprising:

an elevator door movable from an open position to a closed position, the elevator door having a bottom surface;

a gib secured to the elevator door adjacent the bottom surface;

a sill having a guide groove and a face, the gib slidable within the guide groove, the face facing the bottom surface of the elevator door in the closed position; and, a sill gap monitoring system including a sensor assembly configured to sense a sill gap between the sill and at least one of the bottom surface of the elevator door and the gib;

wherein an alert is generated by the sill gap monitoring system when the sill gap is greater than a sill gap limit;

wherein the sensor assembly includes a plunger movable within a plunger housing towards the sill, wherein, when the sill gap limit is exceeded, a plunger head of the plunger contacts the plunger housing and a circuit within the sensor assembly is closed and sends a signal to generate the alert, and wherein, when the sill gap limit is not exceeded, the plunger head does not contact the plunger housing and the circuit is open.

* * * * *